United States Patent [19]

Kelley et al.

[11] Patent Number: 4,469,114

[45] Date of Patent: Sep. 4, 1984

[54] CANOPY-REMOVABLE, PORTABLE

[76] Inventors: Orville Kelley; Vicki Kelley, both of P.O. Box 356, Jeffrey City, Wyo. 82310

[21] Appl. No.: 427,993

[22] Filed: Sep. 29, 1982

[51] Int. Cl.[3] ..... E04B 1/347

[52] U.S. Cl. ..... 135/102

[58] Field of Search ..... 135/88, 102, 117, 120, 135/900–903, 109, 112; 47/26–29, 19

[56] References Cited

U.S. PATENT DOCUMENTS

| | | | |
|---|---|---|---|
| 368,359 | 8/1887 | Tracy et al. | 135/109 |
| 2,167,219 | 7/1939 | San Key | 135/120 X |
| 2,266,853 | 12/1941 | Dabney | 135/120 X |
| 3,082,780 | 3/1963 | Macy | 135/102 |
| 3,190,300 | 6/1965 | Wear'N | 135/102 X |
| 3,802,450 | 4/1974 | Huddle | 135/102 X |

FOREIGN PATENT DOCUMENTS

| | | | |
|---|---|---|---|
| 478512 | 11/1969 | Switzerland | 47/29 |
| 782115 | 9/1957 | United Kingdom | 47/26 |

*Primary Examiner*—James R. Feyrer
*Attorney, Agent, or Firm*—Paul H. Gallagher

[57] ABSTRACT

A canopy for mounting over articles to be protected (vegetables). It includes a U-shape main frame having stakes for driving into the ground at a building, and shield including bows, cooperating with the main frame, carrying a flexible covering. The shield extends to one side of the main frame, forming a cantilever construction. The bows can be folded into position in essentially the plane of the main frame. Securing means is provided for tying the bows in a pack with the main frame, and for anchoring the canopy to the wall of the building.

The canopy can be mounted free of a building, by driving the stakes into the ground, and a pair of them can be mounted in back-to-back position, with the shields extending in opposite directions away from each other, and the securing means can be interconnected to anchor the pair together, for mutual support.

2 Claims, 7 Drawing Figures

10
2
29
14
32
24
28
22
26
16
12
18

14
32
26
12
16
18

32
3.
14
30
12
26
16
18

2
44
42
20
36
5.
24
28
26
34
18
22

40
GROUND
38
5

CANOPY-REMOVABLE, PORTABLE

FIELD OF THE INVENTION AND MAIN OBJECTS THEREOF

The invention resides in a canopy that can be put to any of various uses, such for example as protecting or shielding articles displayed on a table or stand. Such articles are not necessarily displayed at any one position, that is, they may be at different locations as desired, next to a building for example or out in free standing position. When it is desired to display the articles at different locations, it is convenient to be able to place a canopy at any selected position, rather than to position the articles only at certain fixed positions.

Furthermore it may be desired to have a canopy at only one side of a display and cantilevered over the display.

Accordingly a main object of the invention is to provide a canopy for protecting or shielding articles to be displayed that is separate and detached from other articles, and capable of being mounted in selected positions, and being removed therefrom conveniently, as desired.

A more specific object is to provide a canopy of the foregoing general character, having the following specific features and advantages:

1. It is of cantilever construction and thereby convenient for mounting it in many different positions.
2. It can be removably mounted in position either in association with a building, or in free standing position.
3. It can be quickly put in position by simply driving mounting stakes, provided in its structure for the purpose, into the ground.
4. It is foldable into compact position and thereby easily portable.
5. A pair of the canopies can be mounted in free standing position, in back-to-back attitude for providing mutual support between the two.
6. It includes a securing means of wide-use character effective for anchoring the canopy to a building, or for securing a pair of them together in back-to-back position for mutual support, or for securing the folding elements of it in folded position.

DESCRIPTION OF A PREFERRED EMBODIMENT

Figure 1:
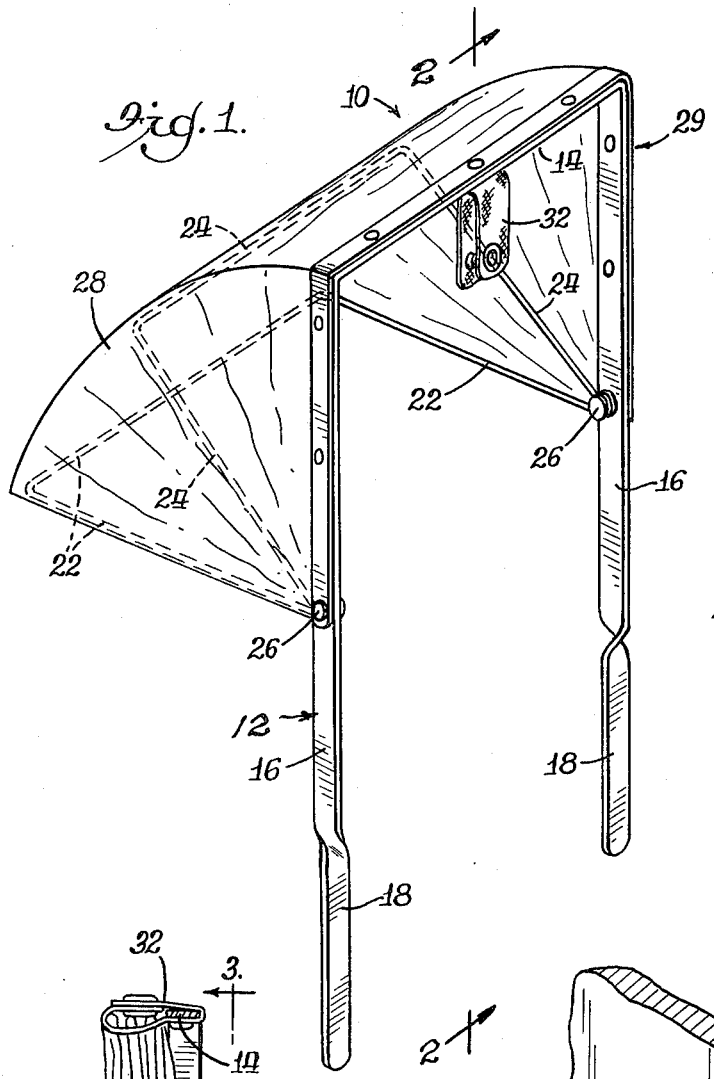
FIG. 1 is a perspective view of a canopy made according to the present invention.

Referring in detail to the drawings, the canopy of our invention is shown in perspective in its entirety at 10 in FIG. 1. The canopy may also be referred to as an awning. The canopy includes a main frame 12 which is generally of U-shape, and inverted U-shape when in use, including a top cross segment 14 and depending legs 16 spaced apart and lying essentially in a plane, so referred to for convenience in orienting the device as a whole. The frame 12 may be of any suitable material, such as steel, but is of relatively great size and strength to support the remainder of the canopy. In a convenient form of the structure, the legs 16 may have flat sides facing each other, and bottom terminal elements 18 forming continuations of the legs themselves, at the free ends of the latter. The terminal elements 18 form stakes for driving into the ground as referred to hereinbelow, and are preferably turned at right angles to the legs 16, thus having flat sides lying in a common plane, adjacent to the plane of the legs 16. These stakes 18 are relatively long for extending into the ground a considerable extent for supporting the canopy, and preferably relatively wide, for presenting great area for anchoring support.

Mounted on the main frame 12 is a shield or hood 20 which includes two or more bows 22, 24, of U-shape, having depending legs pivoted at 26 on the main frame, and a flexible sheet 28 is mounted on and over the bows. For convenience, the main frame 12 may be referred to as a bow, and the bows 22, 24 as auxiliary bows. This sheet may be secured in any suitable fashion, and is flexible and may consist of any suitable material for providing the protection desired, against the sun and rain. The canopy is thus of cantilever construction, the shield extending only in one direction from the main frame. The main frame has what will be referred to for convenience as a back side, indicated at 29.

Figure 3:
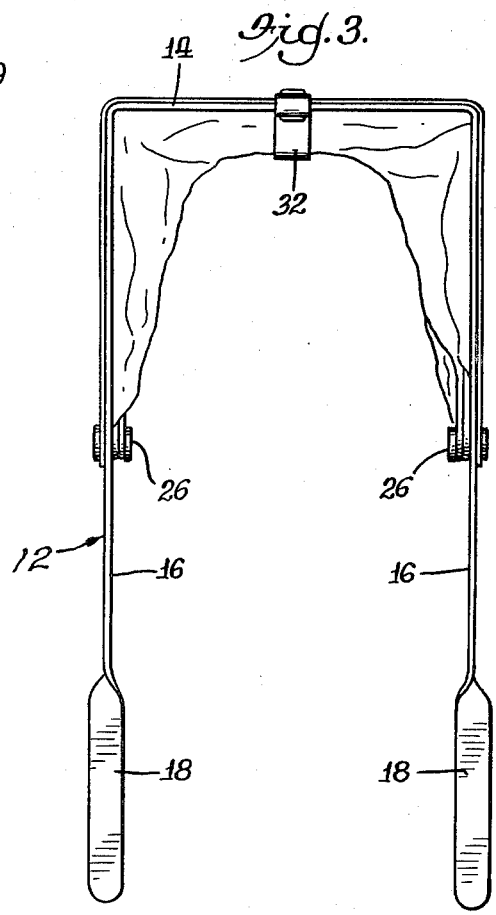
FIG. 3 is a view taken at line 3—3 of FIG. 2.
Figure 2:
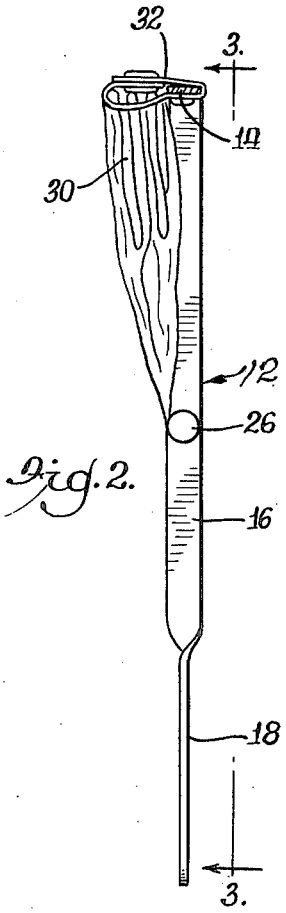
FIG. 2 is a view oriented according to line 2—2 of FIG. 1 with the canopy in folded position and showing securing means holding it in folded position.

The bows 22, 24 are movable between a spread or extended position shown in FIG. 1 and a folded position shown in FIGS. 2 and 3. In the folded position, they are folded up to position close to the main frame 12, and the portions of the sheet between the bows may depend in loops or festoons at 30, the bows and sheet being thus folded into a compact pack or bunch. A fastening or securing means 32 in the form of a tie is preferably provided, such as by mounting it on the top cross 14 and looped around that element and around the adjacent folded portions of the hood and detachably fastened, for holding the canopy in such folded position.

Figure 4:
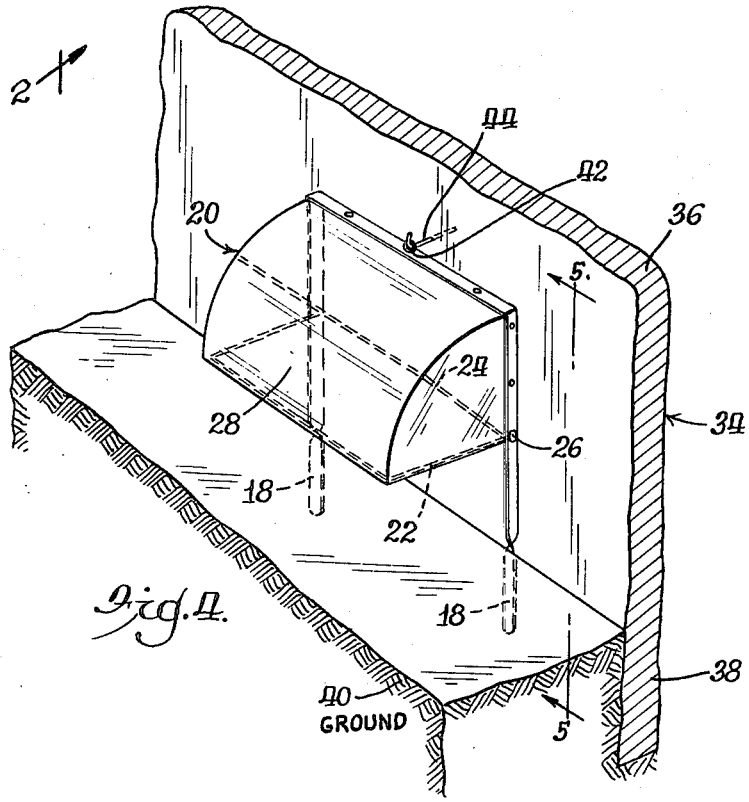
FIG. 4 is a perspective view of the canopy mounted in position adjacent the wall of a building, and showing that wall and a portion of the ground.
Figure 5:
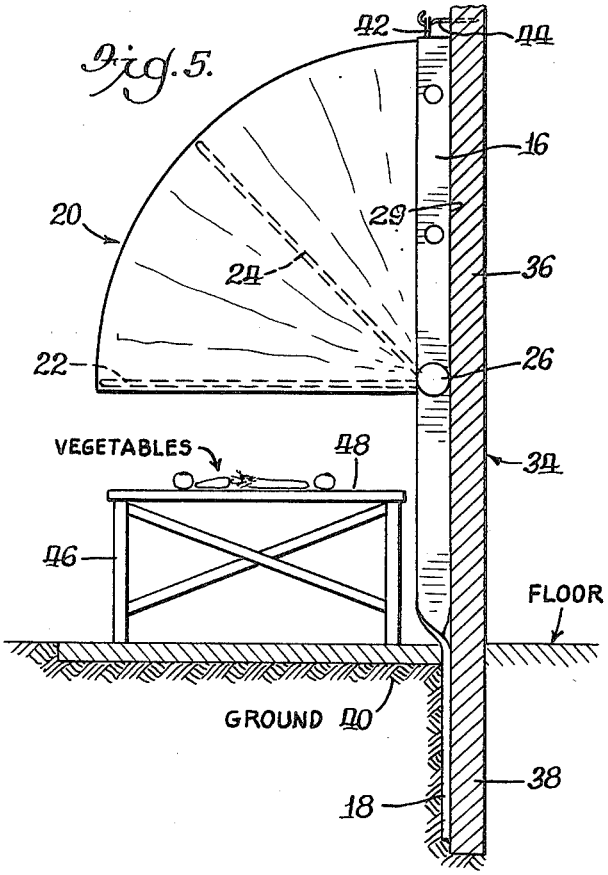
FIG. 5 is a view taken at line 5—5 of FIG. 4.

As noted above a common and often desirable position for mounting the canopy is in association with the wall of a building. Attention is directed to FIGS. 4 and 5 for such a mounting. In these figures a building is indicated at 34 including a wall 36 having a foundation portion 38 embedded in the ground indicated at 40. To mount the canopy in such position, the main frame 12 is fitted with its back side against the outer surface of the wall and the stakes 18 driven into the ground next to the wall of the building, and in engagement with the wall. These stakes are flat in transversely extending direction, as noted above, and as such are fitted flat to the wall throughout their area and for that reason are provided substantial support by the wall. This same flat shape and the wide dimensions of the stakes are engaged by the ground in such directions and are given substantial support by the ground, as well. In the case of a canopy of substantial size, it is usually desired to anchor it at the top, and for this purpose the same loop 32 (FIGS. 2, 3) may be utilized or a ring 42 or similar securing means may be mounted on the top cross piece 14 and a hook 44 mounted in the wall detachably hooking the ring for securing the canopy.

Referring to FIG. 5, in comparison with FIG. 4, a table 46 is shown on the ground adjacent the wall 36 displaying articles 48 which may be vegetables, etc. The shield or hood 20 is of course dimensioned to extend out the desired amount to cover the displayed articles.

Figure 6:
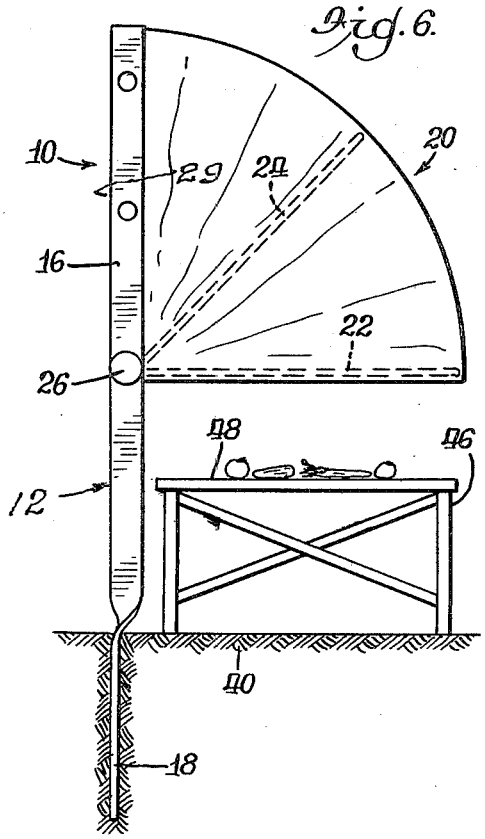
FIG. 6 is a view showing the canopy mounted in free standing position, away from other items such as buildings.

The canopy is not limited to use in association with the building or other structure, but may be mounted in free standing position as represented in FIG. 6. In this case the stakes 18 are merely driven into the ground at a desired location and the engagement with the stakes by the ground, in itself, provides the necessary support for retaining the canopy in upright position. In this case the table 46 is again shown and the shield or hood 20 extends out over the table.

Figure 7:
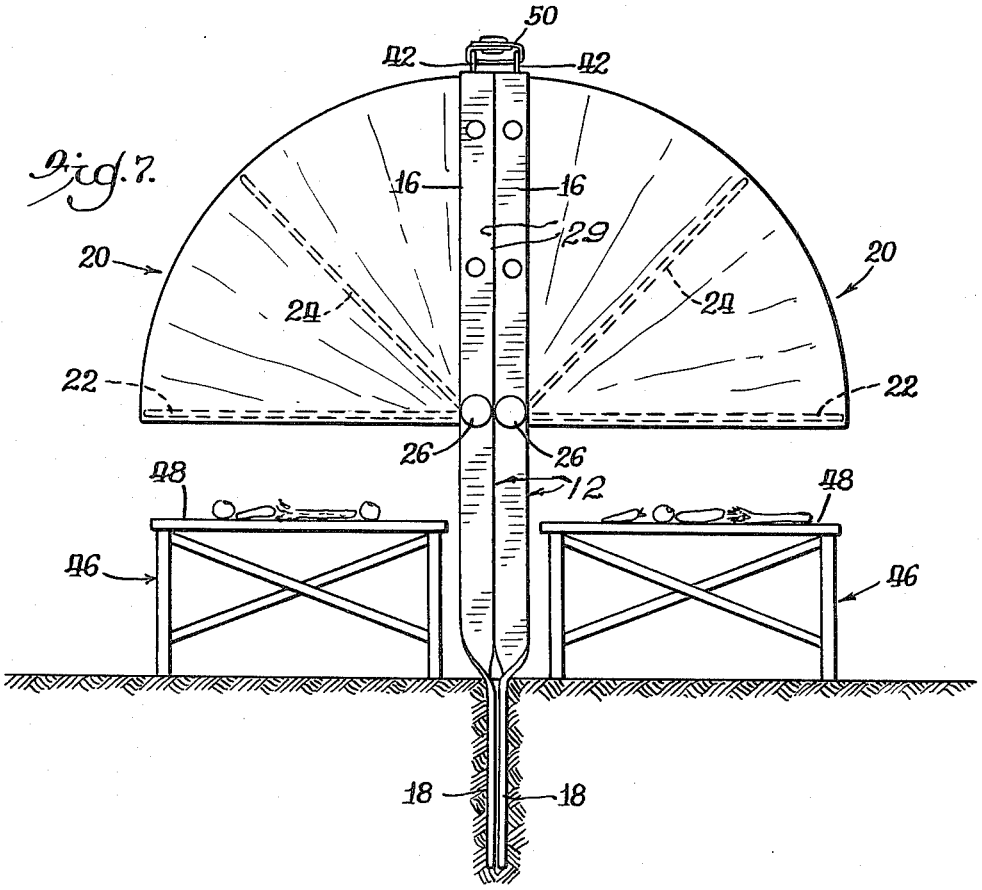
FIG. 7 is a view similar to FIG. 6 but showing two canopies in back-to-back position.

The flexibility of the use of the canopy is represented in a further situation, shown in FIG. 7. As is known tables 46 may be displayed in groups, such as in two opposite locations represented in FIG. 7, the instead of pre-dimensioning a canopy sufficiently large to extend over more than one table, the tables may be spaced apart and a pair of oppositely positioned canopies 10 are mounted back-to-back, in the ground, with the shields or hoods extending in opposite directions over the respective tables. While each canopy normally is well supported alone, two of them together in such back-to-back position provide mutual support, and thus additional support, and still further, the loops or rings 42 may be provided at the top, and a securing means 50 provided, securing the two canopies together. This arrangement provides still greater solidity and consequent support of the canopies.

It will be understood that the proportions and dimensions indicated in the drawings are not limiting, because in a large scale structure, the structural elements would likely be much smaller in dimensions than those indicated in the drawings.

The canopy made according to our invention is very flexible in use, and adaptable to installation in any of a wide variety of situations. It is easily and quickly put in position and as easily removed and stored away. The advantage of placing it in any position selected according to the immediate occasion is a great advantage. When it is desired that the area be entirely cleared, it is then a simple matter to remove the canopy.

While it is highly desired that the shield or hood 20 be flexible, the scope of the invention is sufficiently great to cover non-folding shields, which is plausible in view of new materials being produced almost daily. In so far as the mounting and removability of the canopy are concerned, the folding feature need not be present, but the folding feature is highly desired and is of course an advantage in storing the canopy.

It will be understood that the canopy is not limited to use with the items mentioned, namely vegetables, but for any kind of items such for example as books. Additionally the scope of the invention is such that the canopy may be used over a window, as an awning.

We claim:

1. A removable and portable canopy adapted for covering a display in spaced relation above the display, comprising, a main frame of generally U-shape, having a top cross element and depending legs, the legs continuing downwardly into and including terminal elements at their free lower ends which continue longitudinally from the legs and form stakes adapted to be driven into the ground, the frame having a back side determining essentially a plane, the top cross element and depending legs having broad dimension perpendicular to that plane and the stakes having broad dimension in direction parallel with that plane, and a shield including U-shape bows and a flexible sheet thereon, the bows being pivotally mounted on the main frame on only the front side of the latter, at a position above said stakes and swingable between a spread attitude, in which a lower one of the bows is adjacent and perpendicular to the main frame, and a folded attitude in which the bows and sheet are compacted closely against the main frame, the main frame being relatively great in size and strength, and the bows of the shield being relatively small, and the main frame thereby being capable of entirely supporting the shield, all parts of the canopy being disposed forwardly of said back side plane in all attitudes of the canopy, the canopy being adapted to be mounted by driving the stakes into the ground, and the stakes thereby supporting the main frame and thus the canopy, the perpendicular positioning of the lower bow and its positioning above the stakes, determining the positioning of the shield above the ground in response to the stakes being driven into the ground, whereby a display under the shield is accessible from the exterior of the canopy.

2. A canopy according to claim 1 and including, securing means on the top cross element positioned, when in non-securing attitude, forwardly of said back side plane, the canopy being selectively capable of supporting itself when mounted in the ground, and of being mounted against a wall with its said back side plane positioned substantially in the surface of the wall, and the securing means being operable for securing the canopy stably, and for being mounted in back-to-back relation with another such canopy, and the securing means being operable for securing the two canopies stably together.

* * * * *